US007324051B2

(12) United States Patent
Hayes

(10) Patent No.: US 7,324,051 B2
(45) Date of Patent: Jan. 29, 2008

(54) SUPPLEMENTAL PARASITIC ANTENNA APPARATUS

(75) Inventor: Gerard James Hayes, Wake Forest, NC (US)

(73) Assignee: Sony Ericsson Mobile Communications AB, Lund (SE)

( * ) Notice: Subject to any disclaimer, the term of this patent is extended or adjusted under 35 U.S.C. 154(b) by 107 days.

(21) Appl. No.: 10/963,250

(22) Filed: Oct. 12, 2004

(65) Prior Publication Data

US 2006/0077103 A1 Apr. 13, 2006

(51) Int. Cl.
*H01Q 1/24* (2006.01)

(52) U.S. Cl. ..... 343/702

(58) Field of Classification Search ..... 343/702, 343/700 MS, 756, 814–818, 872
See application file for complete search history.

(56) References Cited

U.S. PATENT DOCUMENTS

| | | | | |
|---|---|---|---|---|
| 5,532,703 | A | 7/1996 | Stephens et al. | |
| 5,566,226 | A | 10/1996 | Mizoguchi et al. | |
| 5,940,038 | A | 8/1999 | Brown et al. | |
| 6,437,745 | B1 * | 8/2002 | Vaisanen et al. | 343/702 |
| 6,456,245 | B1 * | 9/2002 | Crawford | 343/702 |
| 6,509,876 | B1 * | 1/2003 | Jones et al. | 343/702 |
| 6,536,172 | B1 * | 3/2003 | Amend | 52/426 |
| 6,753,826 | B2 * | 6/2004 | Chiang et al. | 343/834 |
| 6,933,896 | B2 * | 8/2005 | Sward et al. | 343/702 |
| 6,980,166 | B2 * | 12/2005 | Gilmore | 343/725 |
| 2003/0176164 | A1 * | 9/2003 | Hefetz | 455/3.06 |
| 2005/0156796 | A1 * | 7/2005 | Nysen | 343/702 |

FOREIGN PATENT DOCUMENTS

| | | |
|---|---|---|
| DE | 100 37 475 | 2/2002 |
| EP | 1 128 465 | 8/2001 |
| WO | WO 98-01919 | 1/1998 |

OTHER PUBLICATIONS

Tritium, Flatenna, Extend WiFi Range, Increase WiFi Range, Long Range, WiFi Antenn . . . , http:/www.tritium.co.uk/Flatennaroot.htm, Printed Jan. 24, 2005.
Tritium, Flatenna Photos, Flatenna Photographs, WLAN Antenna, WiFi Antenna, http:/www.tritium.co.uk/FlatennaPhoto.ht, Printed Jan. 24, 2005.

(Continued)

*Primary Examiner*—Shih-Chao Chen
*Assistant Examiner*—Minh Dieu A
(74) *Attorney, Agent, or Firm*—Myers Bigel Sibley & Sajovec

(57) ABSTRACT

A supplemental antenna assembly is provided for use with an electronic device having an integral radio antenna, such as a wireless-enabled laptop computer, notebook computer, gaming device, personal digital assistant (PDA), or circuit card (e.g., a PCMCIA card) or other circuit assembly designed be used with such a device. The supplemental antenna assembly includes a parasitic element supported by a frame. The frame is configured to be attached to the housing of the portable device such that an inductive coupling is provided between the parasitic element and the integral radio antenna. The parasitic element may include, for example, an antenna and/or a coupling element, e.g., a coupling element configured to be connected to an external antenna.

26 Claims, 10 Drawing Sheets

OTHER PUBLICATIONS

Tritium, Flatenna Specifications, Flatenna Specification, WiFi antenna, WLAN Antenna Hi Gain Ant . . . , http:/www.tritium.co.uk/Flatennaspec.htm, Printed Jan. 24, 2005.
Tritium, Flatenna Frequently Asked Questions, FAQ, http:/www.tritium.co.uk/FAQ.htm, Printed Jan. 24, 2005.
Tritium, Tips and Tricks with your Flatenna, Tips and Tricks, http:/www.tritium.co.uk/TipsTricks.htm, Printed Jan. 24, 2005.
International Search Report and Written Opinion of the International Searching Authority for International patent application No. PCT/US2005/013459 mailed on Sep. 19, 2005.

* cited by examiner

SUPPLEMENTAL PARASITIC ANTENNA APPARATUS

BACKGROUND OF THE INVENTION

The present invention relates to radio communications apparatus, and more particularly, to radio antenna apparatus.

Computing devices, such as laptop computers, notebook computers, pocket PCs, personal digital assistants (PDAs), gaming devices, and the like, now commonly possess wireless communications capabilities. For example, many laptop and notebook computers now incorporate radio communications circuitry configured to communicate with, for example, WiFi networks and/or public cellular networks. Such circuitry may be integrated in the computer and/or may be provided in a circuit assembly, such as a PC card or a USB adapter, which is plugged into the computer. Similar cards and/or adapters may be used with other electronic devices, such as PDAs and computer peripherals (e.g., printers, scanners, and the like)

Such wireless communications circuitry may be configured to connect to an external radio antenna and/or may include an integrated radio antenna. Some PC cards, for example, include an external antenna jack to which a rigid antenna and/or an antenna cable may be attached. A number of PC cards are also available which include an internal antenna without an external antenna connection. For example, referring to FIG. 1, a GC-79 GPRS/WiFi PCMCIA card 100 marketed by SonyEricsson Mobile Conununications, Inc., includes an internal antenna that is positioned within a housing 110 proximate an end of the card 100. Many WiFi cards have a similar internal antenna configuration.

Constraints on the size and positioning of such internal antennas may cause antenna performance to be significantly degraded. For example, as shown in FIG. 2, when a wireless PC card 100 is mounted in a notebook computer 10, the antenna 120 of the card 100 may be blocked or shadowed by the LCD screen of the computer 10. This blockage or shadowing can result in a reduction of gain in certain directions. In addition, when the computer 10 is in a normal operating position, the polarization of the antenna 120 may be dominant in a horizontal plane. However, in certain fringe areas of low signal coverage, signal polarization may be dominantly vertical. The resulting polarization mismatch may lead to significant performance degradation.

SUMMARY OF THE INVENTION

In some embodiments of the present invention, a supplemental antenna assembly is provided for use with an electronic device having an integral radio antenna, such as a wireless-enabled laptop computer, notebook computer, gaming device, personal digital assistant (PDA), or circuit card, adaptor or other circuit assembly designed be used with such a device. The supplemental antenna assembly includes a parasitic element supported by a frame. The frame is configured to be attached to the housing of the portable device such that an inductive coupling is provided between the parasitic element and the integral radio antenna. The parasitic element may include, for example, an antenna and/or a coupling element, such as a coupling element configured to be connected to an external antenna. In some embodiments, the electronic device may preferentially radiate and/or receive radio signals over a frequency range in the absence of the supplemental antenna assembly, and the supplemental antenna assembly may increase radiation and/or reception in the frequency range. In other embodiments, the supplemental antenna assembly may increase radiation and/or reception at a frequency outside of the frequency range such that, for example, the electronic device supports an alternate second radio application.

In further embodiments of the present invention, the electronic device comprises a wireless communications circuit assembly configured to be installed in a computing device. For example, the wireless communications circuit assembly may be a circuit card, e.g., a PCMCIA or other computer card, having a radio antenna positioned proximate an end of the circuit card that extends from the computing device when installed therein. The frame may be configured to be attached to the circuit card proximate the end thereof. For example, the frame may be configured to envelope at least a portion of the circuit card including the integral radio antenna and/or to be retained in a retaining structure on the circuit card.

In further embodiments of the present invention, a supplemental antenna assembly for use with a wireless communications card having an internal radio antenna includes a parasitic element and a frame that supports the parasitic element. The frame is configured to be attached to the wireless communications card proximate the internal radio antenna such that an inductive coupling is provided between the internal radio antenna and the parasitic element. The wireless communications card may comprise a wireless communications PCMCIA card and the frame may be configured to be attached to the PCMCIA card proximate the end of thereof, such that an inductive coupling may be provided between the internal radio antenna and the parasitic element.

DETAILED DESCRIPTION OF EXEMPLARY EMBODIMENTS

Figure 1:
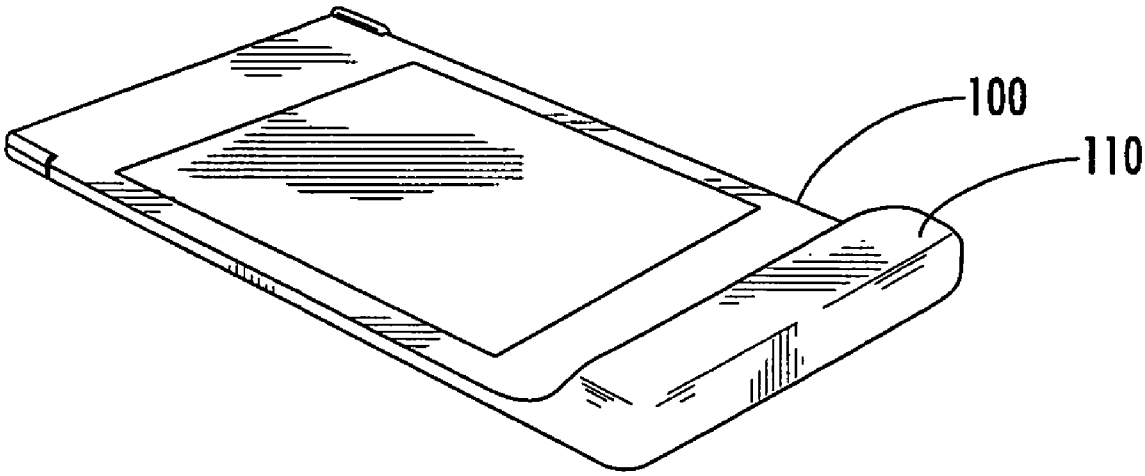
FIG. 1 (PRIOR ART)
FIG. 1 illustrates a conventional PCMCIA wireless communications card.
Figure 2:
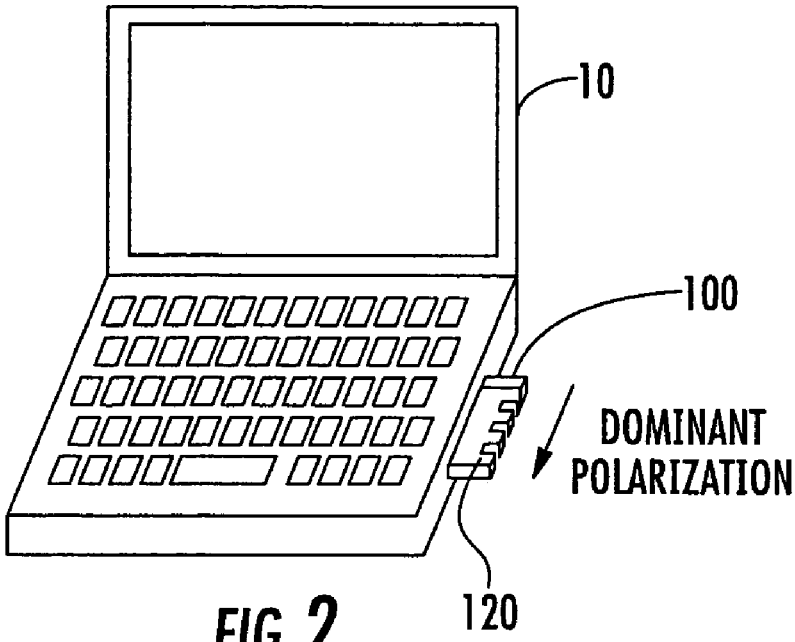
FIG. 2 (PRIOR ART)
FIG. 2 illustrates the conventional PCMCIA wireless communications card installed in a notebook computer.

Specific exemplary embodiments of the invention now will be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the particular exemplary embodiments illustrated in the accompanying drawings is not intended to be limiting of the invention. In the drawings, like numbers refer to like elements.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. Furthermore, "connected" or "coupled" as used herein may include wirelessly connected or coupled. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 3:
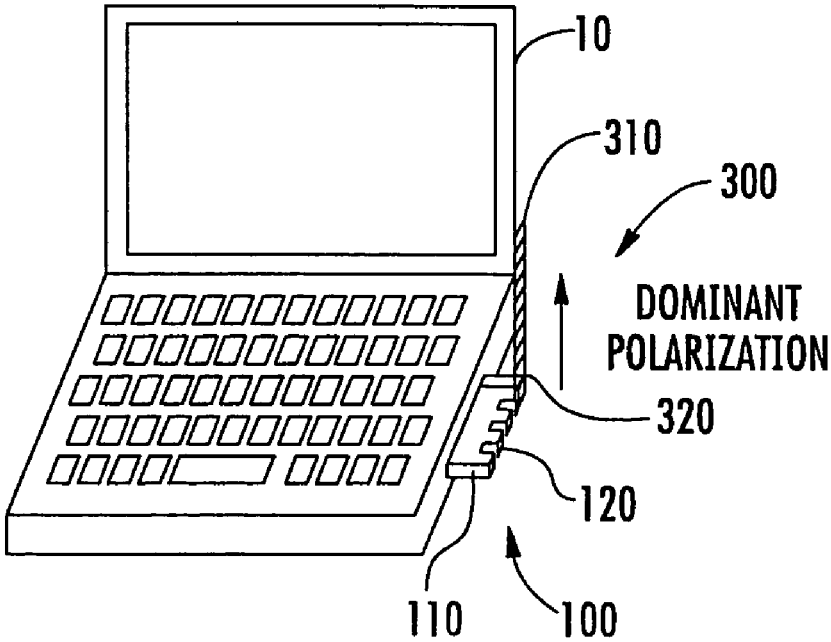
FIGS. 3-11 illustrate supplemental antenna assemblies according to various exemplary embodiments of the present invention.

FIG. 3 is a schematic illustration of a supplemental antenna assembly 300 according to some embodiments of the present invention. The assembly 100 includes a parasitic element 320 and a supporting frame 310 configured to attach to a housing 110 of an electronic device 100 including an integral antenna 120. In particular, in the illustrated example, the electronic device 100 comprises a PCMCIA card configured to be installed in a computer 10, and the antenna 120 comprises a serpentine conductor positioned near the end of the card 100. The frame 310 is shown in the form of a substrate, and the parasitic element 320 comprises a serpentine conductor which is supported by the substrate and vertically oriented to provide a dominant vertical polarization, i.e., substantially orthogonal to the substantially horizontal polarization of the integral antenna 120. It will be appreciated, however, that the present invention is applicable to other electronic devices and/or other antenna configurations.

Figure 4:
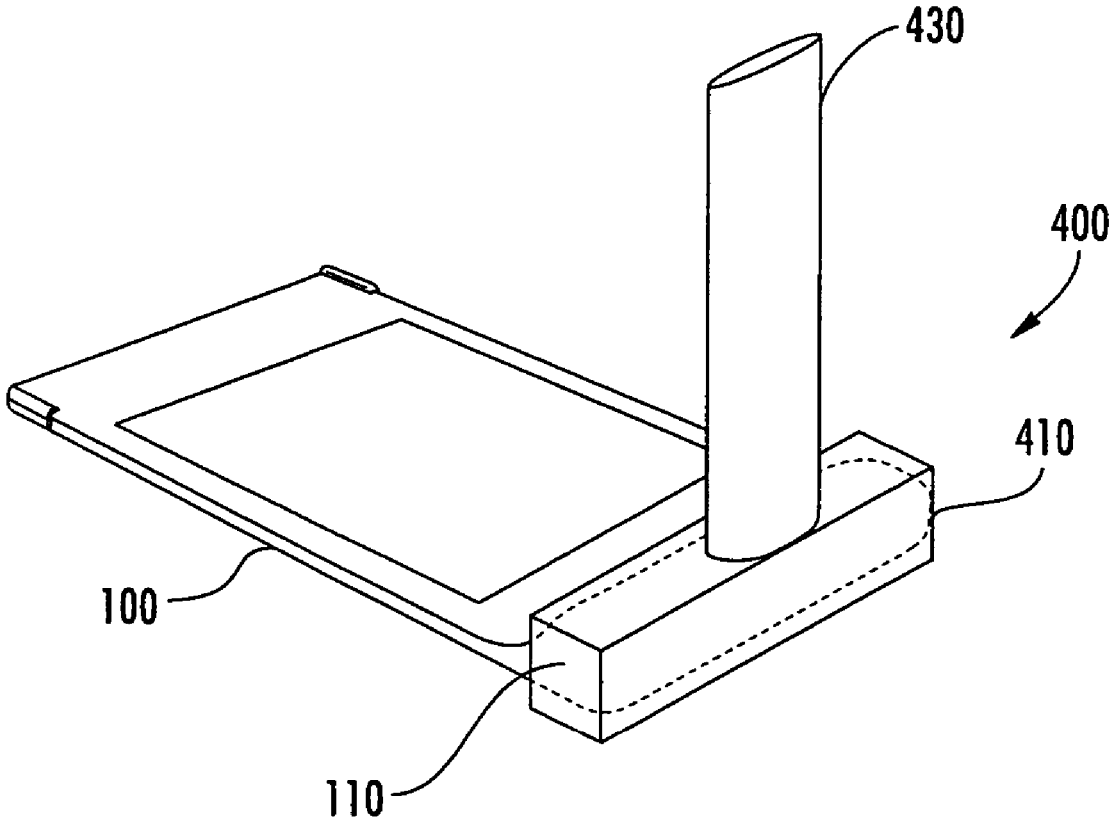
Figure 5:
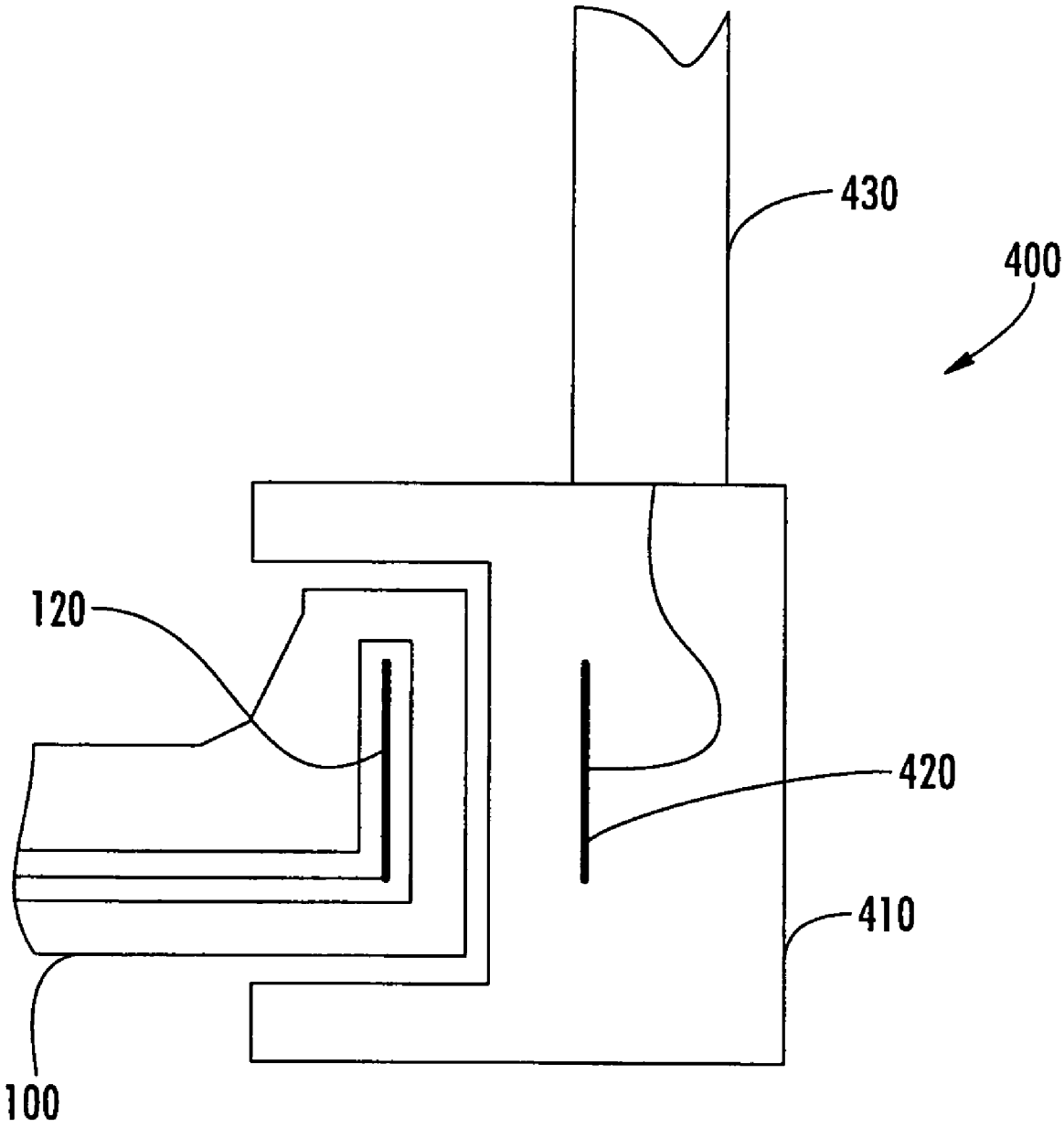

FIGS. 4 and 5 illustrate a supplemental antenna assembly 400 according to further embodiments of the present invention. The assembly 400 includes a frame or housing 410 that is configured to envelope an end 110 of a PCMCIA circuit card 100 that encloses an integral radio antenna 120. The assembly 400 further includes an antenna, here shown as a vertically oriented stub antenna 430, which is parasitically coupled to the integral antenna 120 when the assembly 400 is installed on the card 100. In particular, as shown in FIG. 5, the assembly 400 includes a coupling element 420, positioned in the housing 410, that is configured to inductively (parasitically) couple to the integral antenna 120 of the card when the assembly 400 is installed on the card 100. The coupling element 420 is conductively coupled to the antenna 430. The housing 410 may be configured to snap onto or otherwise engage the end 110 of the circuit card 100 to retain the assembly 400 thereon.

Figure 6:
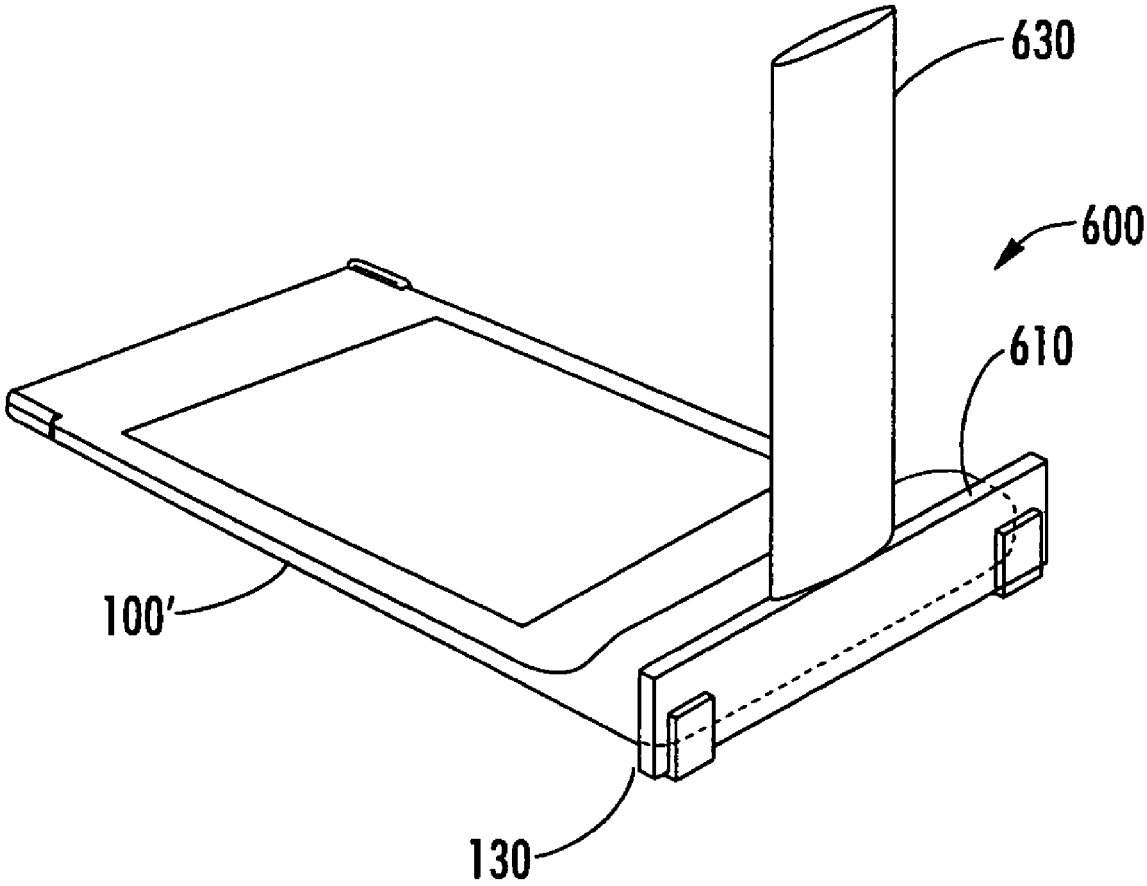
Figure 7:
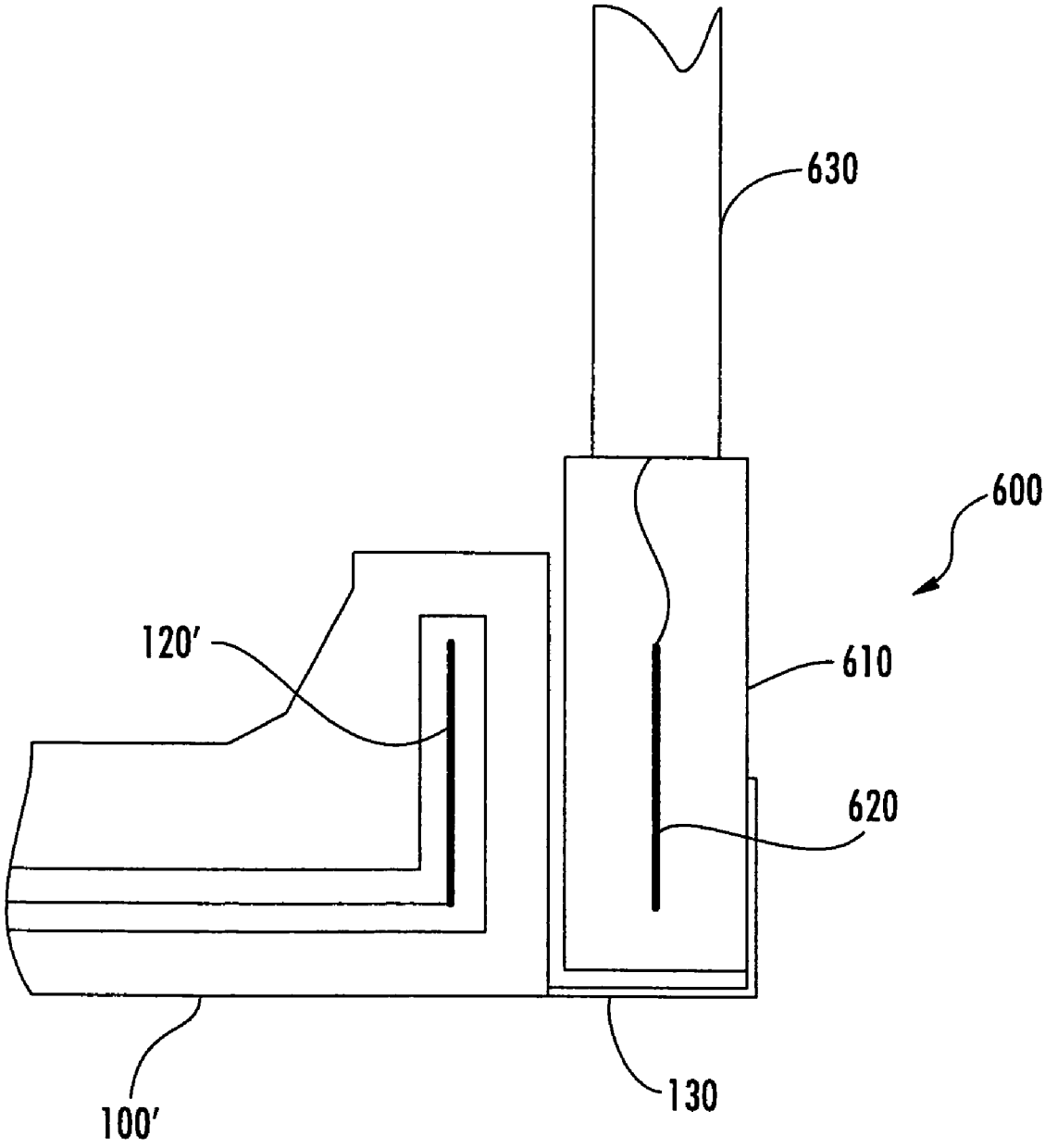

FIGS. 6 and 7 illustrate a supplemental antenna assembly 600 with an alternative configuration according to further embodiments of the present invention. The assembly 600 includes a housing 610 that is configured to slip into slots 130 positioned proximate an end 110' of a PCMCIA circuit card 100' that houses an integral antenna 120'. The housing 610 supports an antenna 630 that is inductively coupled to the antenna 120'. In particular, the assembly 600 includes a coupling element 620, positioned in the housing 610, that is configured to inductively couple to the antenna 120' when the assembly is installed on the card 100', and which is conductively coupled to the antenna 630.

It will be appreciated that, in various embodiments of the present invention, a supplemental antenna assembly may be attached to the housing of an electronic device in ways other than those illustrated in FIGS. 4-7. For example, a supplemental antenna assembly could be configured to be removably attached to a circuit card or other form factor device using, for example, Velcro®, clips, tabs, screws, threads, or other attachment means.

Figure 8:
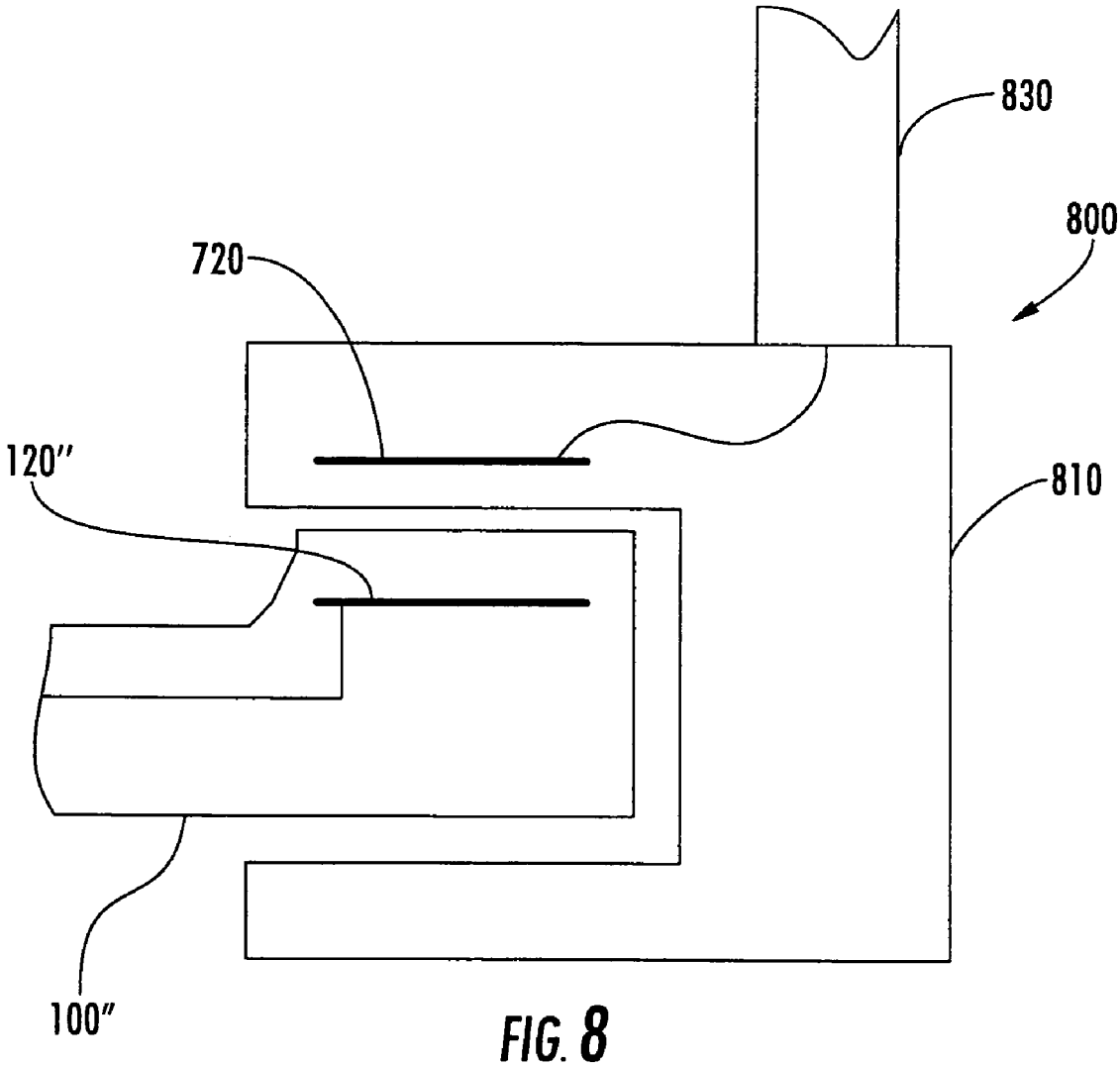

FIG. 8 illustrates a supplemental antenna assembly 800 for use with a circuit card 100" having an internal antenna 120" with a different orientation than the internal antennas shown in FIGS. 4-7. The assembly 800 includes a housing 810 that is configured to envelope an end of the circuit card 100" proximate the antenna 120". The housing 810 supports a coupling element 720 in a position such that it may be parasitically coupled to the antenna 120" when the assembly 800 is in place. The coupling element 720 is conductively coupled to an antenna 830.

Figure 9:
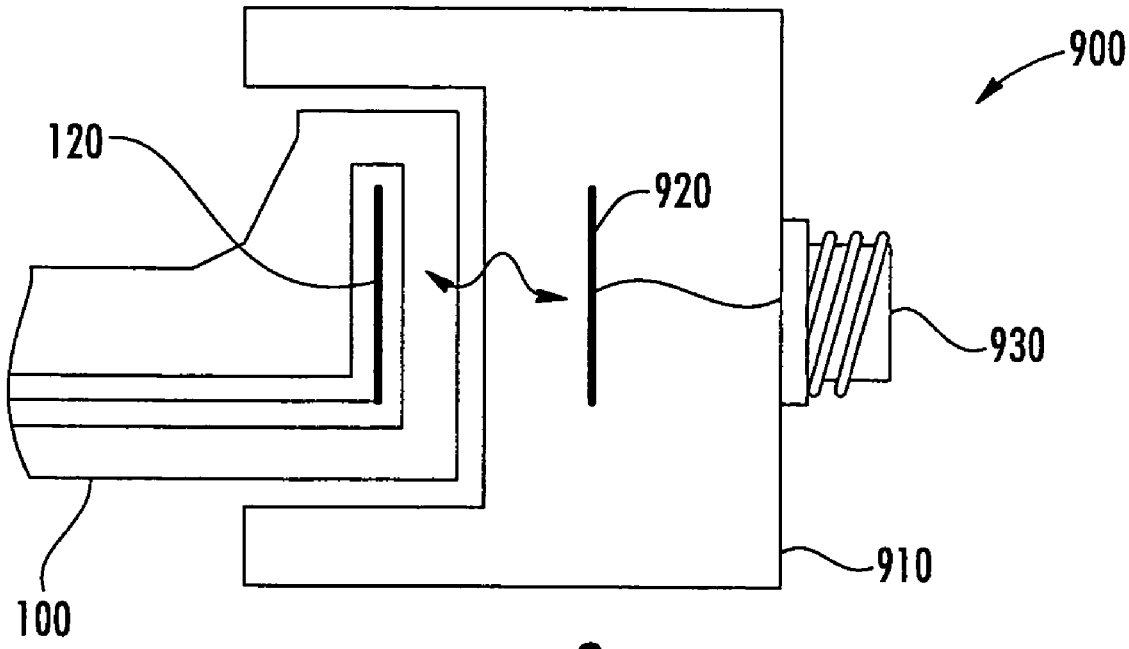

According to further aspects of the present invention, a supplemental antenna apparatus for use with an electronic device having an integral antenna may include a parasitic coupling element that is configured to be removably connected to a rigid external antenna, such as a stub antenna, and/or to an antenna cable that may be attached to a freestanding antenna. For example, as shown in FIG. 9, a supplemental antenna assembly 900 according to further embodiments of the present invention includes a housing 910 configured to envelop an end of a circuit card 100 that houses an internal antenna 120. The assembly 900 further comprises a parasitic coupling element 920 that is configured to be inductively coupled to the antenna 120 when the assembly 900 is installed. The coupling element 920 is conductively coupled to an external antenna connector 930. In various embodiments, a rigid antenna and/or an antenna cable may be connected to the connector 930.

Figure 10:
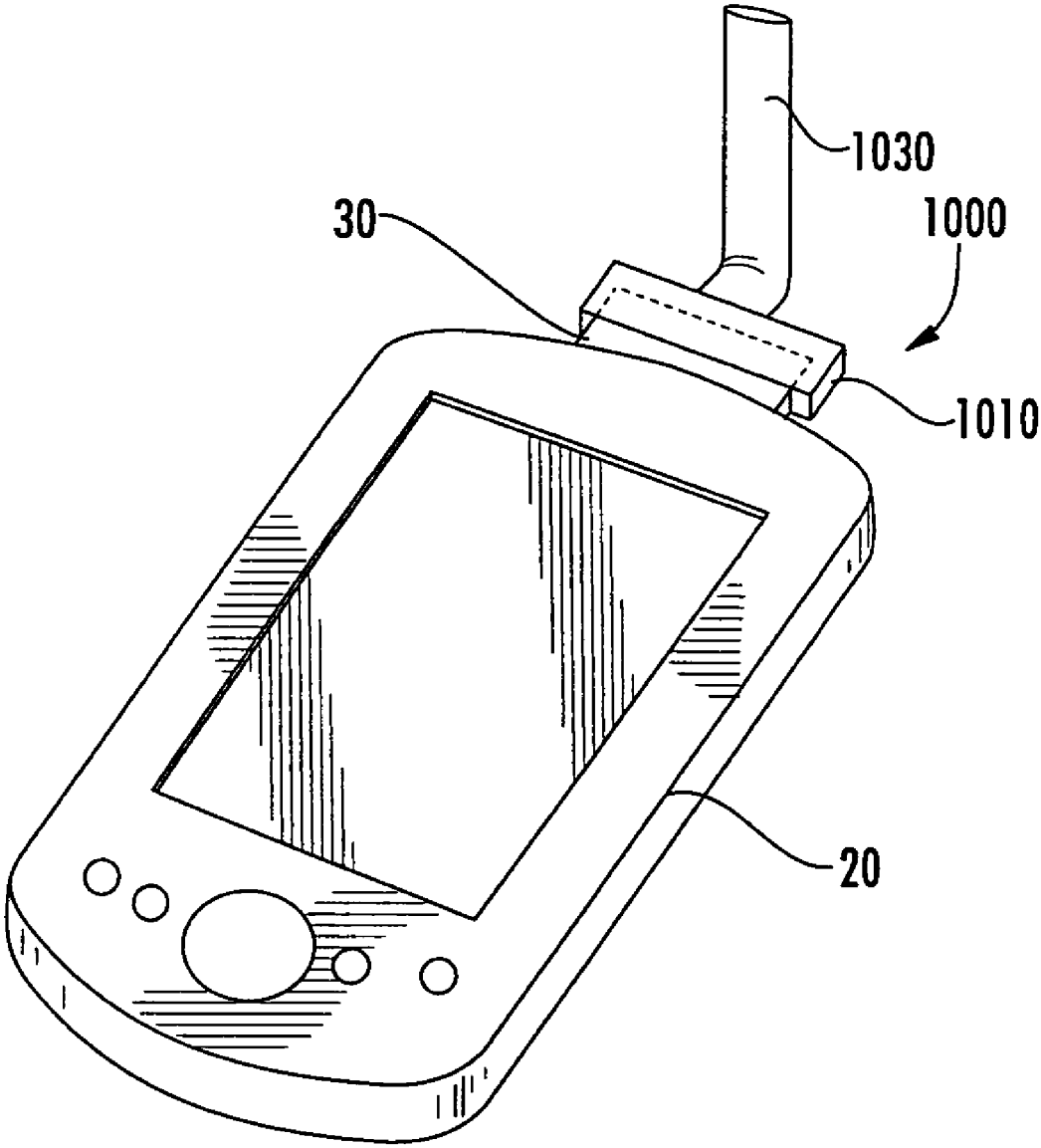
Figure 11:
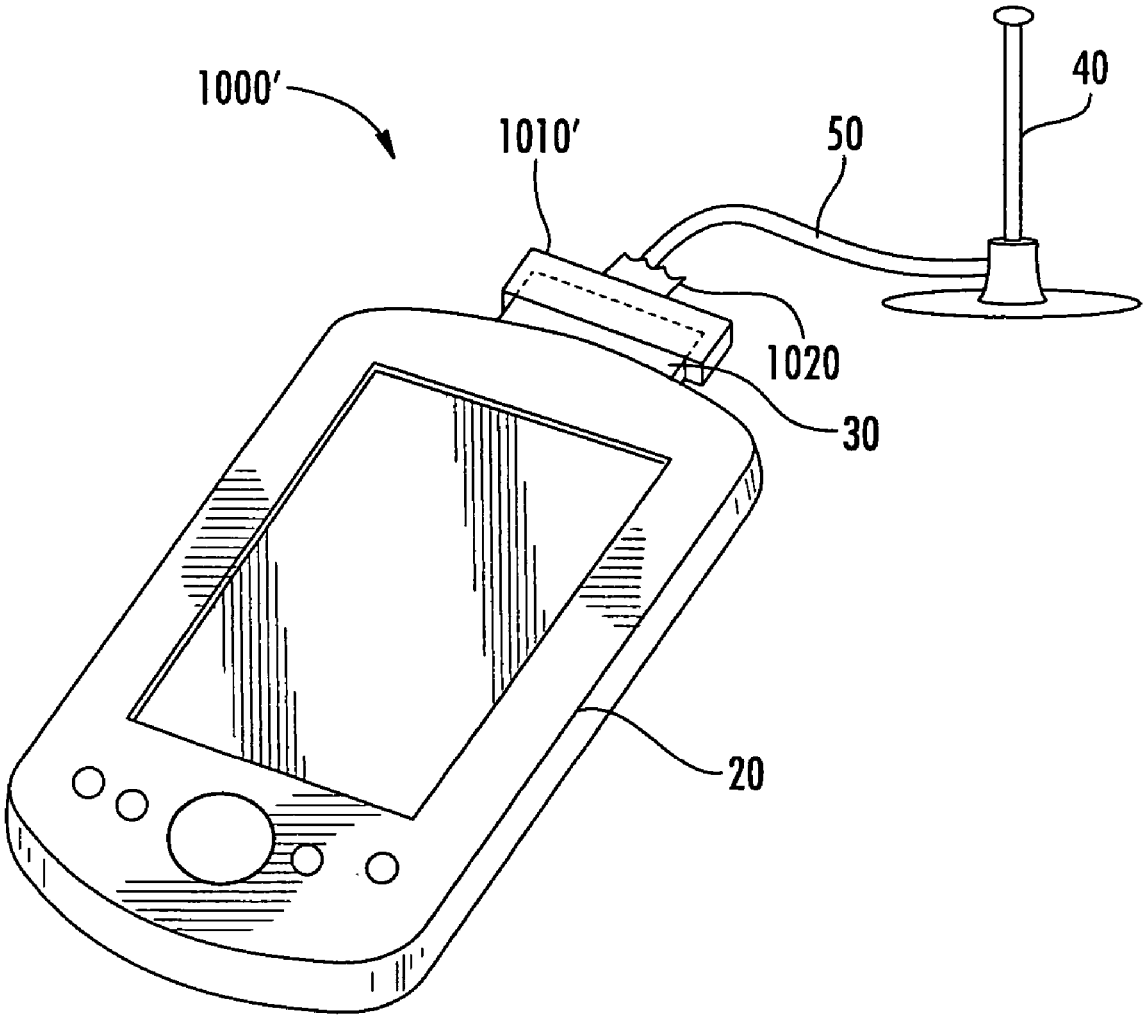

It will be appreciated that the present invention is applicable to other types of electronic devices than PCMCIA circuit cards. For example, FIGS. 10 and 11 illustrate supplemental antenna assemblies 1000, 1000' configured for use with a wireless communications card 30 inserted in a PDA 20. Referring to FIG. 10, the assembly 1000 includes a housing 1010 that envelopes the circuit card 30 and that supports a parasitically coupled antenna 1030. Such an assembly may be used, for example, when the PDA 20 is being used in a high-blockage environment, such as in an automobile. Referring to FIG. 11, the assembly 1000' includes a housing 1010' that includes a parasitic coupling element (not shown) that is connected to an external connector 1020. A freestanding antenna 40 is connected to the connector 1020 by a cable 50. Such a configuration may be useful, for example, when the PDA 20 is mounted in a fixed position, e.g., inside a vehicle or a building.

Other applications of supplemental parasitic antenna assemblies fall within the scope of the present invention. For example, in some embodiments of the present invention, supplemental parasitic antenna assemblies may be configured to couple to integral radio antennas mounted in the case of a computer or other electronic device, rather than in a removable circuit card or other circuit assembly. In further embodiments, supplemental parasitic antennas may be configured for use with other radio devices, such as messaging devices, gaming devices, radiotelephones (e.g., handsets) and/or GPS receivers.

Performance of an electronic device may be improved using a supplemental parasitic antenna assembly according to various embodiments of the present invention. For example, improvements in radiation/reception characteristics, such as voltage standing wave ratio (VSWR), gain, and/or directivity, may be achieved using such a supplemental antenna assembly. Such a supplemental antenna assembly may also be used to provide additional or enhanced operational modes. For example, addition of a supplemental parasitic antenna may modify an internal antenna's existing pattern, such that reception and/or radiation is improved in a frequency range that is relatively attenuated when the parasitic element is absent. Thus, for example, if an integral antenna of an electronic device is configured to support a given radio application, addition of a parasitic element according to some embodiments of the present invention could support an additional or alternative radio application.

In the drawings and specification, there have been disclosed exemplary embodiments of the invention. Although specific terms are employed, they are used in-a generic and descriptive sense only and not for purposes of limitation, the scope of the invention being defined by the following claims.

The invention claimed is:

1. A supplemental antenna assembly for use with an electronic device having an integral radio antenna disposed in a housing of the electronic device, the supplemental antenna assembly comprising:

a parasitic element;

a frame that supports the parasitic element and that is configured to be attached to the housing of the portable device such that an inductive coupling is provided between the parasitic element and the integral radio antenna; and wherein the integral radio antenna of the electronic device has a first dominant polarization, and wherein the parasitic element includes an antenna that, when attached to the housing of the electronic device, has a second dominant polarization.

2. A supplemental antenna assembly according to claim 1, wherein the parasitic element comprises an antenna.

3. A supplemental antenna assembly according to claim 1, wherein the parasitic element comprises a coupling element.

4. A supplemental antenna assembly according to claim 3, wherein the coupling element is configured to be connected to an external antenna.

5. A supplemental antenna assembly according to claim 1, wherein the electronic device comprises a wireless communications circuit assembly configured to be installed in a computing device.

6. A supplemental antenna assembly according claim 5, wherein the wireless communications circuit assembly comprises a circuit card, wherein the radio antenna of the wireless communications circuit assembly is positioned proximate an end of the circuit card that extends from the computing device when installed therein, and wherein the frame is configured to be attached to the circuit card proximate the end thereof.

7. A supplemental antenna assembly according to claim 6, wherein the frame is configured to envelope at least a portion of the circuit card including the integral radio antenna.

8. A supplemental antenna assembly according to claim 6, wherein the frame is configured to mate with a retaining structure on a surface of the circuit card.

9. A supplemental antenna assembly according to claim 1, wherein the frame is configured to envelope at least a portion of the housing proximate the integral radio antenna.

10. A supplemental antenna assembly according to claim 1, wherein the frame is configured to mate with a retaining structure on a surface of the housing.

11. A supplemental antenna assembly according to claim 1, wherein the electronic device preferentially radiates and/or receives radio signals over a frequency range in the absence of the supplemental antenna assembly, and wherein the supplemental antenna assembly, when installed, increases radiation and/or reception in the frequency range.

12. A supplemental antenna assembly according to claim 1, wherein the electronic device preferentially radiates and/or receives radio signals over a frequency range in the absence of the supplemental antenna assembly, and wherein the supplemental antenna assembly, when installed, increases radiation and/or reception of radio signals at a frequency outside of the frequency range.

13. A supplemental antenna assembly according to claim 1, wherein the electronic device preferentially supports a first radio application in the absence of the supplemental antenna assembly, and wherein the electronic device preferentially supports a second radio application when the supplemental antenna assembly is installed.

14. A supplemental antenna assembly for use with a wireless communications card having an internal radio antenna and configured for removable installation in an electronic device, the antenna assembly comprising:

a parasitic element; and a frame that supports the parasitic element and that is configured to be removably attached to the wireless communications card proximate the internal radio antenna such that an inductive coupling is provided between the internal radio antenna and the parasitic element.

15. A supplemental antenna assembly according to claim 14, wherein the parasitic element comprises an antenna.

16. A supplemental antenna assembly according to claim 14, wherein the parasitic element comprises a coupling element.

17. A supplemental antenna assembly according to claim 16, wherein the coupling element is configured to be connected to an external antenna.

18. A supplemental antenna assembly according claim 14, wherein the radio antenna of the wireless communications card is positioned proximate an end of the wireless communications card that extends from a computing device when installed therein, and wherein the frame is configured to be attached to the wireless communications card proximate the end thereof.

19. A supplemental antenna assembly according to claim 14, wherein the frame is configured to envelope at least a portion of the wireless communications card including the internal radio antenna.

20. A supplemental antenna assembly according to claim 14, wherein the frame is configured to mate with a retaining structure on a surface of the wireless communications card.

21. A supplemental antenna assembly according to claim 14, wherein the internal radio antenna of the wireless communications card has a first dominant polarization, and wherein the parasitic element includes an antenna that, when attached to the wireless communications card, has a second dominant polarization.

22. A supplemental antenna assembly according to claim 14, wherein the wireless communications card is configured for installation in a portable computing device.

23. A supplemental antenna assembly for use with a wireless communications PCMCIA card havina an internal radio antenna positioned proximate an end thereof, the supplemental antenna assembly comprising:

a parasitic element; and a frame that supports the parasitic element and that is configured to be removably attached to the PCMCIA card proximate the end of thereof such that an inductive coupling is provided between the internal radio antenna and the parasitic element.

24. A supplemental antenna assembly according to claim 23, wherein the parasitic element comprises an antenna.

25. A supplemental antenna assembly according to claim 23, wherein the parasitic element comprises a coupling element configured to be connected to an external antenna.

26. A supplemental antenna assembly according to claim 23, wherein the internal radio antenna of the PCMCIA card has a first dominant polarization, and wherein the parasitic element includes an antenna that, when attached to the wireless communications card, has a second dominant polarization substantially orthogonal to the first dominant polarization.

* * * * *

UNITED STATES PATENT AND TRADEMARK OFFICE

CERTIFICATE OF CORRECTION

PATENT NO. : 7,324,051 B2
APPLICATION NO. : 10/963250
DATED : January 29, 2008
INVENTOR(S) : Hayes It is certified that error appears in the above-identified patent and that said Letters Patent is hereby corrected as shown below:

Column 6, Claim 23, Line 59: Please correct "PCMCIA card havina"
To read -- PCMCIA card having --

Signed and Sealed this

Twentieth Day of May, 2008

JON W. DUDAS
*Director of the United States Patent and Trademark Office*